United States Patent [19]

Kalt et al.

[11] 4,336,536

[45] Jun. 22, 1982

[54] REFLECTIVE DISPLAY AND METHOD OF MAKING SAME

[76] Inventors: Charles G. Kalt, 29 Hawthorne Rd., Williamstown, Mass. 01267; Bryce Babcock, 1025 State Rd., North Adams, Mass. 01247

[21] Appl. No.: 103,995

[22] Filed: Dec. 17, 1979

[51] Int. Cl.[3] ..... G09G 3/16

[52] U.S. Cl. ..... 340/783; 340/764

[58] Field of Search ..... 350/269; 340/764, 783, 340/763

[56] References Cited

U.S. PATENT DOCUMENTS

| | | | |
|---|---|---|---|
| 3,648,281 | 3/1972 | Dahms et al. | 340/764 |
| 3,897,997 | 8/1975 | Kalt | 350/269 |
| 4,105,294 | 8/1978 | Peck | 350/269 |
| 4,160,582 | 7/1979 | Yasuo | 350/269 |
| 4,160,583 | 7/1979 | Ueda | 350/269 |
| 4,163,162 | 7/1979 | Micheron | 340/783 |

*Primary Examiner*—Marshall M. Curtis

*Attorney, Agent, or Firm*—Anthony H. Handal; Michael N. Meller

[57] ABSTRACT

A variable reflectivity display which defines a plane of display (92) is disclosed. It comprises a fixed electrode (16) which defines a first reflective surface having a first reflectivity. A shield (20) defines a second reflective surface having a second reflectivity. The second reflectivity is different from the first reflectivity. A flexible tongue (18) having a mirrored surface is supported in a position where one side of the tongue (18) is adjacent to the shield (20). Means for attracting the tongue to the fixed electrode is provided. The shield and fixed electrode are configured and dimensioned, and supported in a position in facing relationship with respect to each other in such a manner that when the side of the tongue (16) opposite the mirrored surface is in abutting relationship to one of the reflective surfaces, that one of the reflective surfaces supports the tongue (16) forming the mirrored surface into a shape where light incident upon the element is incident upon the other of the reflective surfaces, or is incident upon the mirrored surface and reflected against the other of the reflective surfaces or reflected from the mirrored surface at an angle with respect to the plane of display (92) that is less than (180−A)/2 degrees, where A is the useful angle of view of the display device.

15 Claims, 21 Drawing Figures

REFLECTIVE DISPLAY AND METHOD OF MAKING SAME

TECHNICAL FIELD

The invention relates to a two-dimensional reflective display; the reflective display is comprised of a matrix of pixels which may be selectively activated to vary their reflectivity. The inventive display matrix operates under ambient lighting conditions and as a backlighted display for use in the darkness. The invention facilitates the production of a large number of pixels in a single display and, at the same time, provides for the practical addressability of each individual pixel with a desired video input. Particularly advantageous optics are achieved by forming the fixed electrodes and supporting the mylar tongues in such a manner that the angle defined between them is relatively small.

BACKGROUND ART

The most common two-dimensional display system is the cathode ray tube which is employed in such widely diverse applications as electronic instrumentation and metering equipment, television broadcast receivers, and data and word processing systems. This diversity of applications notwithstanding, employment of the cathode ray tube in such systems presents substantial problems. For example, it is difficult and expensive to drive a tube with solid-state circuitry. Extremely high voltages are required and power consumption is relatively high. The tube is very large compared to the display area and, for many applications, cannot be practically made larger than about twenty-five inches in diameter. In addition, the images which appear on a cathode ray tube are of relatively low intensity and are not as visible under bright lighting conditions.

A number of systems have been proposed as alternatives to the cathode ray tube. One such class of devices is the liquid crystal. This device will operate at relatively low voltages and with a very low level of power consumption. However, the liquid crystal, which is normally used as a reflective device, experiences only a very subtle change in its reflectivity when it is activated. Accordingly, it is difficult to discern information displayed on a liquid crystal under a variety of conditions.

Nevertheless, in spite of its drawbacks, the liquid crystal has seen application in such areas as calculators and watches, because of its advantages compared to conventional cathode ray tube displays.

Another alternative to the cathode ray tube is the light emitting diode or LED. While, dependent upon the material of which it is made, an LED will emit coherent radiation of a given wavelength, perhaps the most commonly used LED is made of gallium arsenide and emits red light when it is activated. Compared to liquid crystal displays, LED displays are quite vivid. They also retain the advantage of low-voltage drive circuitry. Because of these characteristics, they have seen exceptionally wide application in such devices as watches, calculators and are now even being used as alpha-numeric displays on memory typewriters and other business equipment systems.

However, the LED has a number of serious drawbacks. Problems include bigger expense per square inch and high power consumption of the LED as compared to the liquid crystal. Thus, a large display would necessarily require a great number of light emitting diodes and would have a correspondingly enormous level of power consumption.

Moreover, LED display systems are not practical under bright lighting conditions such as sunlight, which tends to overpower the display in the same manner that it overpowers cathode ray tube displays.

Perhaps the newest technology to be applied to the field of displays is the electrostatic display. Such a system is shown in U.S. Pat. No. 3,553,364 issued to Lee on Jan. 5, 1971. This patent illustrates a light valve which operates primarily as a light transmissive device. In one embodiment, Lee discloses a device which comprises a housing which is substantially transparent except for a pair of leaf shutters which are disposed adjacent each other in the center of the housing and secured to a common support at their bases. When activated the unsecured portion of each leaf is attracted toward the housing, causing the leaves each to extend toward an edge of the housing opposite from its support point, thus blocking the passage of light through the housing. Thus, when the housing is backlight, it appears bright in the unactivated state and dark when activated. However this device also has a number of disadvantages. For example, backlighting the device requires a relatively large amount of power. Moreover, because of the fact that it is a light emitting device, it would appear that the device would not be an effective display in environments where the ambient light is at relatively high intensity levels.

Another approach in using electrostatic technology is shown in U.S. Pat. No. 3,648,281 issued to Dahms et al on Mar. 7, 1972. Dahms discloses an electrostatic display panel which comprises a pair of planar square fixed electrodes supported at a relatively wide angle with respect to each other to form a V-shaped groove. At the bottom of the groove, an electrically conducting leaf is hingedly secured to the bottom of the groove. One of the fixed electrodes is painted black and the other is painted white. The side of the leaf facing the black electrode is painted black and the side of the leaf facing the white electrode is painted white. In operation, the leaf is attracted to one electrode or the other, thus modulating the intensity of reflected light. This device has excellent characteristics under high intensity lighting conditions because, like the liquid crystal, it is purely a reflective device. However, unlike the liquid crystal it has excellent contrast. However, it does suffer from several problems. Primarily, Dahms chooses a relatively wide angle because of what he characterizes as the advantageous viewing characteristics of a wide-angle groove structure. One would expect this because making Dahms structure with a narrow angle would hinder the display considerably due to the effect of shadows and distortion. However, the use of a wide angle structure necessitates excessively high driving voltages and rather clumsy leaf hinging structures. Moreover, the response time of a wide angle structure is relatively slow, making driving at video speeds of only limited value.

In my earlier issued U.S. Pat. No. 3,897,997, the disclosure of which is hereby incorporated by reference, I described an electrostatic display device with variable reflectivity in which the variable electrode is metalized and wraps over the fixed electrode to change its appearance. The device described there includes a fixed electrode which has an effective operating surface that is curved and has at least 120 degrees of arc in order to achieve wide effective viewing angle. The viewing angle is enhanced by reflection of the fixed electrode in the metalized variable electrode or flapper.

In my earlier issued U.S. Pat. No. 4,094,590, the disclosure of which is hereby incorporated by reference, there is disclosed a display device including a fixed electrode and a flapper. In this device, the flapper is given a bend in order to provide an advantageous mounting structure.

In my earlier U.S. Pat. No. 3,989,357, an electrostatic device useful for modulating transmitted light is described. In particular, the system there disclosed, comprises a light source which backlights the device which may be activated to prevent transmission of light through the device.

DISCLOSURE OF INVENTION

The invention as claimed is intended to provide a solution to the problem of providing a display panel having a large number of display elements or pixels with advantageous optical properties, both as a display operating under ambient lighting conditions and as a backlighted display for use in the darkness. Moreover, the structure of the invention is advantageous inasmuch as it facilitates the production of a large number of pixels in a single display and, at the same time, provides for the practical addressability of each individual pixel with a desired video input.

The same is accomplished by providing a display panel which comprises a plurality of shielding means arranged in a row and positioned at spaced intervals with respect to each other, with each of the shielding means having a surface of first reflectivity. A plurality of conductive fixed electrodes, each of which have a surface of second reflectivity are positioned with their surfaces of second reflectivity in facing relationship to the surfaces of first reflectivity. Means are provided for supporting the fixed electrodes and the shielding means in the above-described placement with respect to each other. A plurality of tongues, each having a base portion and a tip portion, are defined in a single sheet of mylar in such a manner that the tongues are arranged in a row. The mylar sheet is positioned and configured with the tongues interposed between facing surfaces of first and second reflectivity. Means are provided for supporting the mylar with the tip portion of the tongue in spaced relationship to the surface of second reflectivity. First conductive means are provided for electrically connecting to the tongues and a plurality of second conductive means are provided to connect to each of the fixed electrodes.

Particularly advantageous optics are achieved by forming the fixed electrodes and supporting the mylar tongues in such a manner that the angle defined between them is relatively small. It is contemplated that a display panel constructed in accordance with the present invention would include a plurality of rows such as those described above, as will be described in conjunction with the accompanying drawings and specification.

BRIEF DESCRIPTION OF DRAWINGS

One way of carrying out the invention is described in detail below with reference to the drawings which illustrate only two specific embodiments of the invention, in which.

BEST MODE FOR CARRYING OUT THE INVENTION

Figure 1:
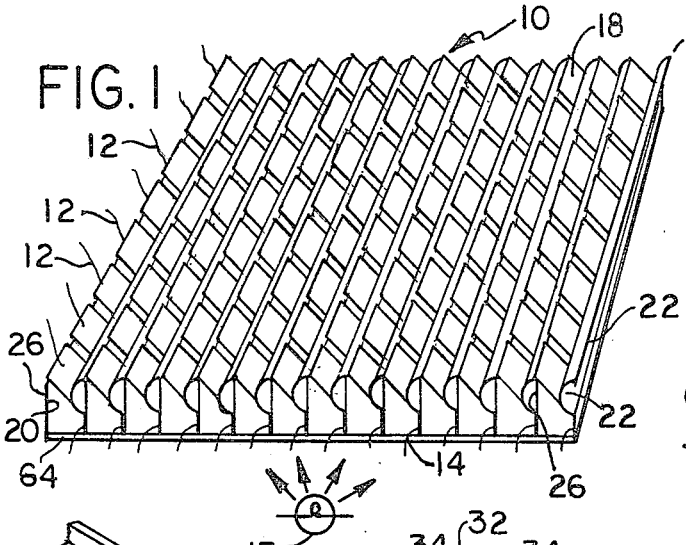
FIG. 1 is a perspective view of a display panel constructed in accordance with the present invention.

The figures show a reflective display panel 10 (FIG. 1) constructed in accordance with the present invention. The panel comprises a $8 \times 14$ matrix of pixels. Each of the pixels in panel 10 may be separately activated by application of a voltage between its respective one of the horizontal leads 12 and it respective one of the vertical leads 14. When it is desired to display information on the panel 10, the horizontal and vertical leads are provided with information corresponding to the message which one wishes to display. The display panel 10 may then be viewed under reflected ambient light or, by a transmitted light supplied by a backlighting source 17. Thus, the instant display would be suitable for use under varied lighting conditions. These may include outdoor use where daylight would illuminate the display during the day while the display would be self-illuminating during the darkness of the night. However, as will be understood from the description which appears below, it may be advantageous to reverse the electrical information fed to panel 10 by leads 12 and 14 to maintain positive information positive and negative information negative during backlighting of the display.

Figure 2:
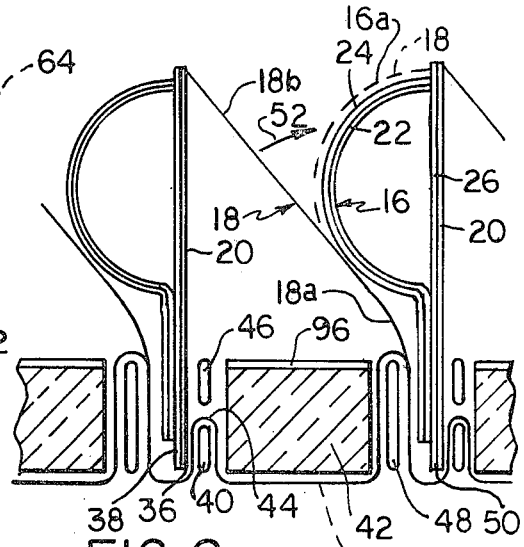
FIG. 2 is a cross-sectional diagramatic representation of a single pixel of the panel illustrated in FIG. 1.

The operation of each individual pixel will now be described with particular reference to FIG. 2. The basic operating components of each pixel are a fixed electrode 16, a variable electrode or tongue 18, which includes a base portion 18*a* and a tip portion 18*b*, and shield 20. As shown most clearly in FIGS. 2 and 3, the fixed electrode 16 comprises a curved conductive member 22 which may be of a cylindercal shape and formed of sheet aluminium or other similar material. Curved member 22 is covered with an insulative layer 24, such as red paint, which serves as a dielectric. Tongue 18 may be most advantageously made of double-metalized mylar having a thickness of approximately 0.0025 centimeters. Tongue 18 is urged into the illustrated position by being displaced by fixed electrode 16 which has an outer portion 16*a*.

Shield 20 may be made of black conductive paint (such as that sold under the trademark Aqua Dag manufactured by the Acheson Colloids Corporation of Port Huron, Mich. under catalog number ES-37G) supported by a mylar substrate 26 having a thickness of approximately 0.025 centimeters. Alternatively the shield may be any spacing means to maintain space between the fixed electrode and the tongue of adjacent pixels.

Figure 4:
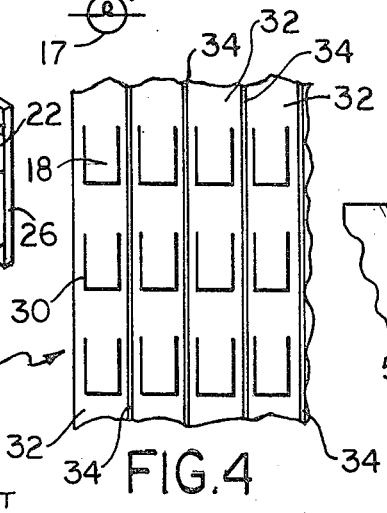
FIG. 4 is a view of the mylar sheet forming a portion of the display of FIG. 1 showing tongues cut therein.

Tongue 18 is part of a mylar sheet 28, as shown in FIG. 4. Tongues 18 are cut from sheet 28 by cutting along lines 30. A plurality of tongues are formed in a single row 32. Row 32 are separated by linear insulative strips 34 where the metalized alluminium has been removed from both sides of the mylar.

Figure 5:
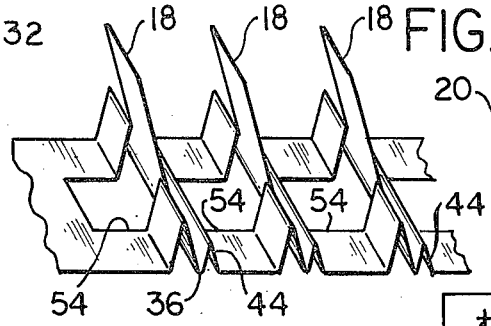
FIG. 5 is a perspective view of a portion of the mylar sheet diagramatically illustrating how the sheet is to be formed when incorporated into a pixel such as that illustrated in FIG. 2.

In addition to being cut and made to define a plurality of rows of tongues as illustrated in FIG. 4, the mylar sheet 28 is folded as shown diagramatically in FIG. 5. Referring to FIG. 2 in conjunction with FIG. 5, it is thus seen that the mylar is bent at a point 36, bringing it into contact with lower portion 38 of shield 20. Sheet 28 then bends around shim 40 and returns to the base of the structure passing underneath a clear plastic bar 42. The purpose of shim 40 is to prevent the mylar from creasing too sharply at point 44, as this will cause a discontinuity in the conductive layer deposited on sheet 28. A shim 46 fills the gap created by shim 40, thus maintaining the structural strength of the panel 10. Although shim 40 could be made to extend the combined length of shims 40 and 46, this would result in additional consumption of mylar and, accordingly, additional manufacturing cost. As shown in the figures, tongues 18 protrude upwardly from the bent sheet 28 which passes underneath bar 42 and around shim 48 and from there to the next pixel. Shims 40, 46 and 48 may be made of mylar having a thickness of approximately 0.005 centimeters. Sheet 28 and tongues 18 are prevented from coming into electrical contact with conductive curved member 22 by the insulative paint layer 24. Likewise, curved member 22 is offset from the base 50 of each pixel, thus preventing contact between these members due to some discontinuity in insulative layer 24 at the base of curved member 22. As noted above, shield 20 is in contact with sheet 28 and, accordingly, is in electrical contact with tongue 18. Tongue 18 and shield 20 are thus at the same electrical potential. In the unactivated state, tongue 18 assumes the position shown in solid lines in FIG. 2. However, once activated by the application of a voltage between tongue 18 and fixed electrode 16, as illustrated by the dashed connections in FIG. 6, tongue 18 moves in the direction of arrow 52 and assumes the position shown in dashed lines in FIG. 2. In the unactivated state the pixel assumes the color of the insulative layer 24, in the preferred embodiment red. Specifically, a viewer sees the insulative layer, or, when he views tongue 18, the reflection of the insulative layer. When the pixel is activated, the tongue moves to the position illustrated in phantom lines in FIG. 2. In this position, the pixel appears black, inasmuch as the viewer sees either the shield 20, which is black, or its reflection, which is also black as reflected by tongue 18.

Figure 7:
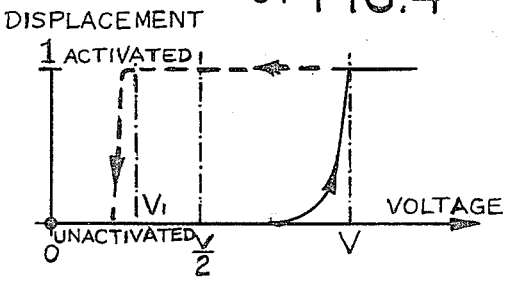
FIG. 7 is a diagram of voltage versus tongue displacement for a pixel such as that illustrated in FIG. 2.

The operation of an individual pixel is illustrated in FIG. 7. In its unactivated state, the pixel assumes the position shown in solid lines in FIG. 2. As voltage is applied between the tongue 18 and the fixed electrode 16, the tongue 18 begins to wrap itself around the fixed electrode. When the trigger voltage is reached, it has completed wrapping itself around the fixed electrode and the tongue thus assumes the position shown in phantom lines in FIG. 2. The displacement of the tongue is shown diagramatically by the solid line in FIG. 7. Once the activation voltage V has been applied between the fixed electrode and the tongue, it is only necessary that a lesser voltage V′ be applied between the electrodes in order to maintain the pixel in the activated state. In a typical device, such as that illustrated in the figures, voltage V is in the order of about 140 volts. The holding voltage V′ is typically in the order of 30 volts.

As shown most clearly in FIG. 5, all of the tongues 18 in panel 10 may be formed from a single sheet 28 of double-metalized mylar film. The tongues are divided into rows by insulative strips 34 where the metalized coating has been removed from both sides of the sheet 28. Thus, all of the tongues 18 in each row are electrically connected to each other. Moreover, because each tongue is electrically connected to its respective shield 20 all of the shields in each row are connected to each other. This can be seen most clearly by considering FIGS. 2 and 5. In FIG. 5 the electrical isolation provided between the adjacent rows by strip 34 is most apparent as is the configuration of mylar sheet 28. Electrical connection between shields 20 and tongues 18 in each pixel is shown most clearly in FIG. 2.

Figure 8:
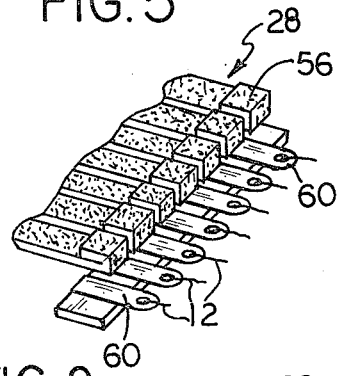
FIG. 8 is a partial detail perspective of part of the connection means for connecting to the panel.

With particular reference to FIG. 5, it is also noted that the portions of mylar sheet 28 underneath plastic bars 42 are largely cut away and displaced, creating a plurality of windows 54 in each row. This allows light 17 to be placed behind panel 10 to provide a display during the dark hours. Electrical connection between metalized coatings on both sides of the mylar and to each row is accomplished by rolling the end portion 56 of sheet 28 as shown in FIG. 8. A terminal strip connector 58 is then bought into abutting pressing relationship to the rolled end portion 56. This brings terminals 60 into electrical contact with rows 32 and allows the connection of horizontal leads 12 by soldering to these terminals.

Figure 3:
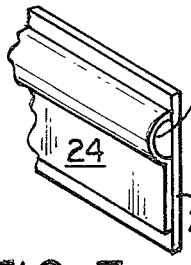
FIG. 3 is a perspective view long lines 3—3 of FIG. 2 of a fixed electrode employed in the inventive panel.
Figure 9:
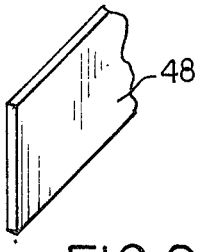
FIG. 9 is a partial perspective view of a shim incorporated in the pixel of FIG. 2.
Figure 10:
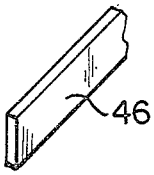
FIG. 10 is a partial perspective view of another shim incorporated in the pixel of FIG. 2.
Figure 11:
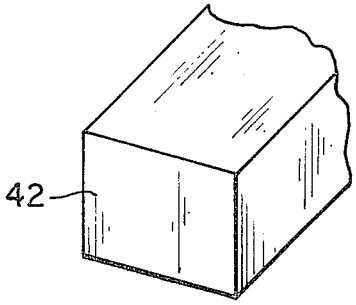
FIG. 11 is a partial perspective of a light transmitting support bar incorporated in the pixel of FIG. 2.

While adjacent pixels in each row have tongues 18 and shields 20 which are in electrical contact with each other, adjacent pixels in each column have fixed electrodes 16 which are electrically connected to each other. More specifically, all of the fixed electrodes in each column incorporate the same single curved member 22, as illustrated in FIG. 3. Curved member 22 is made of sheet aluminum having a thickness of approximately 0.015 centimeters. Curved member 22 is mounted on substrate 26 and extends the length of each column, as is illustrated most clearly in FIG. 1. Likewise, shims 48 (FIG. 9), shims 40 and 46 (FIG. 10) and clear plastic bar 42 (FIG. 11) also extend the length of each column of pixels.

Figure 12:
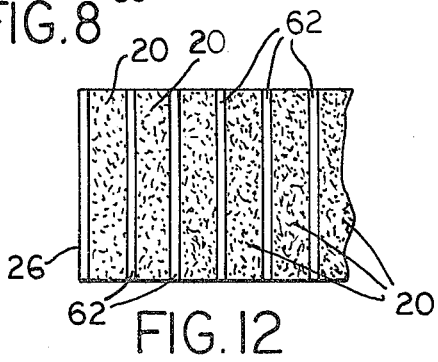
FIG. 12 is a view along lines 12—12 of the fixed electrode assembly illustrated in FIG. 2, illustrating the placement of a shield on an insulated substrate.

The construction of substrate 26 is illustrated in FIG. 12. While each substrate 26 extends the length of its column, the conductive paint shields 20 deposited on it must be electrically insulated from each other because they belong to the same electrical circuit as the tongues, which are isolated from tongues in other rows by insulative strips 34. Thus, the shields 20 are deposited in strips on substrate 26 with insulative strips 62 between them. The structural integrity of the system is maintained by a support bar 64 which extends the length of a row of pixels and is glued to the edges of plastic bars 42.

Figure 13:
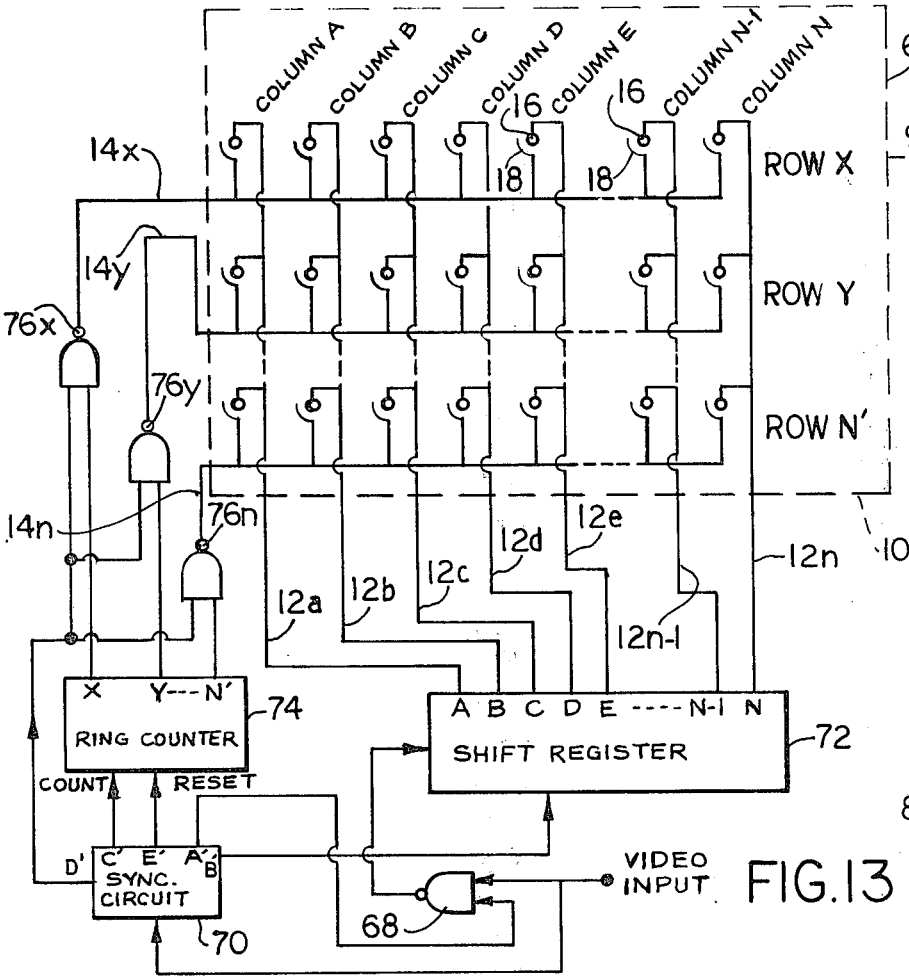
FIG. 13 is a schematic diagram of a display panel and a circuit for driving the same with video information.

Thus, all of the tongues in each row of pixels are electrically connected together while being isolated from tongues in other rows, and all of the fixed electrodes in each column of pixels are connected to each other while they are electrically isolated from fixed electrodes in other columns. This electrical configuration is schematically illustrated in FIG. 13 in which the components of panel 10 are included within a dashed line 66. FIG. 13 shows a scanning circuit for feeding video information to panel 10.

This particular circuit makes use of the electrostatic hysterisis which is characteristic of a pixel constructed in accordance with the present invention.

There is a great deal of hysteresis in the operation of an individual pixel. While a potential V is required to switch the device to the "on" state, a potential V/2 is sufficient to maintain it in that state (FIG. 7). On the other hand, if originally in the "off" state the device will remain in that state if a potential V/2 is applied across it. In this condition its state depends on the previous history of the device. This principle allows one to multiplex a display made up of such elements.

Figure 6:
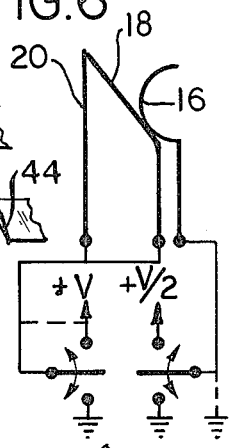
FIG. 6 is a schematic diagram showing an electrical circuit for activating a pixel.

The driving arrangement for an individual multiplexed pixel is shown in FIG. 6. As shown, electrode 18 is operated at either zero potential or V (the activation potential) while electrode 16 operates at zero potential or V/2. There are four different states then in which the pixel may be placed. We first consider the cases for electrode 16 at zero potential. If electrode 18 is also at zero potential, the pixel is in the "off" state. If electrode 18 is at potential V, the pixel is in the "on" state. Next we consider the cases for electrode 16 at V/2. For whichever state electrode 18 is in (zero or V) there is only a potential V/2 between the two electrodes. This means that the device is in the "inactive" or "hold" state. Its present condition depends on the state it was in at the moment electrode 16 went to V/2. Once in this state electrode 18 can be switched from zero to V or vice versa without changing the state of the pixel provided this is done rapidly enough to prevent the device from responding mechanically while the driving voltage is varying between zero and V, and thus passing through V/2 where the potential across the pixel is zero. Since the device can flip within the order of a millisecond, this means that any change in the potential of electrode 18 should take place considerably faster than 1 ms.

An additional advantage of this driving technique is that the potential across an individual pixel in the "hold" state will alternate polarity as its column switches state. This has the effect of neutralizing dielectric soak in the device.

For the purpose of this description, we will refer to the display panel as comprised of a matrix of pixels each having a fixed electrode 16 and tongue 18, which are associated into a plurality of vertical columns (labeled Columns A, B, C, D, . . . N-1, N in FIG. 13) having fixed electrodes 16 connected to the fixed electrodes of the other pixels in their respective columns. Columns A–N are driven, respectively, by horizontal leads 12*a–n*. Likewise, the pixels in the matrix which comprises panel 10 are divided into horizontal rows X, Y . . . N′. In each row X–N′ the tongues are connected to the other tongues in the row and, respectively, to vertical leads 14*x–n*′.

As shown in FIG. 13, video information enters a gate 68 and a synchronization circuit 70. In response to timing information extracted by the synchronization circuit 70, gate 68 passes the video information to a shift register 72 which places the information to be loaded into columns A–N, respectively, at its outputs A–N. If, for a given row of information, the respective pixel corresponding to one of the shift register's outputs A–N is to be activated, the shift register produces at that output a voltage equal to the activation voltage V of a pixel. If the pixel is not to be activated the corresponding output appears at ground.

As shown in the diagram of FIG. 13, the respective output of the shift register corresponding to the column of the pixel to be driven is coupled to the fixed electrodes of all of the pixels in the column of the pixel to be driven. However, as will be described below, the tongues of all of the pixels which are not to be driven are coupled to a voltage which is equal to half the voltage V needed for activation of an individual pixel. Accordingly, as described previously, the rows which one does not wish to feed with information retain the information previously sent to them. The proper synchronization of rows of pixels to the incoming signal is maintained by a ring counter 74 which provides sequencing information in combination with a plurality of gates 76*x–n*′.

Figure 14:
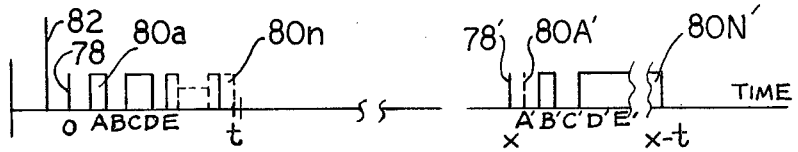
FIG. 14 is a diagram of a typical video signal.

The operation of the circuit illustrated in FIG. 13 will become more apparent upon the consideration of a typical video signal such as that illustrated in FIG. 14. The video signal comprises a sequence of video information beginning with a timing pulse 78 followed by a series of information pulses 80A, B, C, D, E, . . . N-1, N. After a period of time a second timing pulse 78′ occurs and in turn is followed by a sequence of information pulses 80A′–80N′. The pulses 80A–N represent the information to be displayed in a row of the matrix. Likewise, pulses 80A′–N′ represent the information to be displayed in the next to be scanned rows of pixels.

It may also be desired to provide a second timing pulse 82 of greater magnitude than timing pulse 78 to signify that the set of pulses 80A–N following it is to be displayed in the first row of pixels to be scanned.

Figure 18:
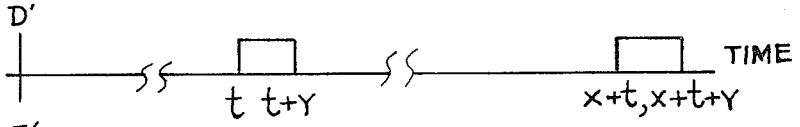
FIG. 18 is a diagram of the drive enabling pulse output of the synchronization circuit.

Thus, when the video signal illustrated in FIG. 14 is coupled to the circuit of FIG. 13 by being coupled to its video input, pulse 82 is sent to synchronization circuit 70, together with the first timing pulse 78, which resets ring counter 74. When ring counter 74 is reset only its X output is at a potential with respect to ground, while its other outputs are at ground potential. Thus, all of the gates 76, with the exception of gate 76*x* is disabled by the output of the ring counter. In this state, gates 76*y–n* have a voltage output of half the activation voltage of an individual pixel, making their respective pixels insensitive to voltages of zero or the activation voltage. However, the D′ output (FIG. 18) of the synchronization circuit 70 is also at ground potential, thereby disabling the output of gate 76*x* and maintaining its output at half the activation voltage. Thus the output appearing at outputs A–N of shift register 72 will not be loaded into any of the pixels in panel 10.

Figure 15:
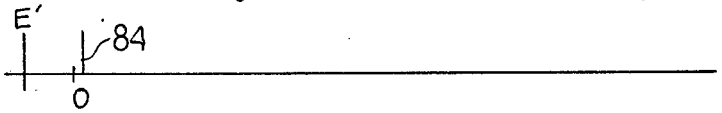
FIG. 15 illustrates the E′ output of the synchronization circuit.

Resetting of the ring counter can be seen most clearly with reference to FIG. 15 which shows the output of the E′ terminal of synchronization circuit 70 which generate a pulse 84 when pulses 82 and 78 have been detected. Likewise, as seen most clearly in FIG. 18, the output of output D′ is, at the beginning of the cycle (including the beginning of the time during which information is to be received by the circuit), at ground potential, thereby disabling the gates 76*x–n*′.

Figure 16:
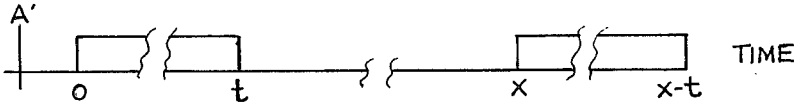
FIG. 16 illustrates the video transmission enabling output of the A′ terminal of the synchronization circuit.
Figure 17:
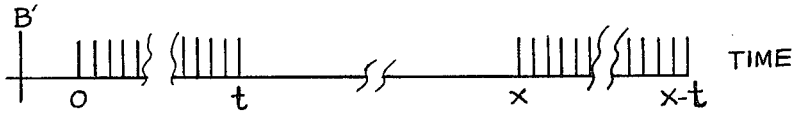
FIG. 17 illustrates the clocking pulses generated by the synchronization circuit.
Figure 19:
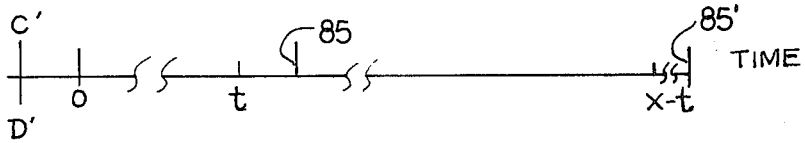
FIG. 19 illustrates the synchronization output signal which advances the ring counter from one row to another in the inventive display.

As soon as a timing pulse 78 is received, the circuit must be made ready to receive the video information in the form of pulses 80A–N to follow. Accordingly, output A′ of circuit 70 goes positive as shown in FIG. 16. This output is coupled to one of the inputs of gate 68, thereby enabling gate 68 to transmit the video signal at its other input to the input of shift register 72. Shift register 72 receives the video signal in response to clocking pulses provides at output B′ of synchronization circuit 70 as illustrated in FIG. 17. At time t the last of the pulses 80A–N have been received and stored in the shift register. Accordingly, gate 68 is disabled by output A′ of synchronization circuit 70, which, drops to ground potential, as illustrated in FIG. 16. Thus, shift register 72 has at its output the video signal illustrated between 0 and time t in FIG. 14. As shown most clearly in FIG. 18 output D′ then goes positive for a period of time y long enough for a pixel to change state. The output of output D′ of synchronization circuit 70, which is positive, is coupled to the input of gate 76*x* together with the only positive output of ring counter 74. Thus, the output of gate 76*x* becomes 0 while the output of the other gates 76*y–n*′ remain at V/2. Accordingly, only the pixels in row x will be able to change state in response to the outputs A–N of shift register 72. After time y has expired the output D′ of synchronization circuit 70 returns to 0 thus preventing the pixels from changing state. After this has occured, a pulse 85 (FIG. 19) is delivered to the ring counter advancing its state so that only its output Y is now active.

Ring counter 74 is one of the type which when reset produces a high voltage at its output X and ground potential at its other outputs and, upon receiving a pulse at its COUNT input sequentially causes one of its outputs at a time to go high while maintaining the other outputs at ground potential.

Thus, upon being reset the X output is high while the others are at ground; upon receiving a pulse at its COUNT input, its output X goes low and its output Y goes high; upon receiving a second pulse at its COUNT input its output Z (not shown) would go high while its output Y would return to ground potential, and so forth. Thus, upon receiving pulse 85, only output Y of ring counter 74 is high as noted above. Gates 76*x* and 76*z–n*′ are disabled by the ring counter. While one of the inputs of gate 76*y* is coupled to output Y of ring counter 74, its other input is connected to output D′ of synchronization circuit 70. Accordingly, its output is also disabled and like the other outputs of the other gates 76*x* and *z–n*′ is at a voltage equal to half the actuation voltage of a pixel.

Thus, the first cluster of information represented by pulses 80A′–N′ and meant for row x of panel 10 have been loaded into row x and the circuit has been prepared to receive the next row of information. It then becomes necessary to repeat the cycle for pulses 80A′–N′. To do this, the circuit substantially repeats the above sequence with the detection of timing pulse 78′ (FIG. 14) by synchronization circuit 70. Circuit 70 then produces a pulse having a duration t at its A′ output, thus enabling gate 68 to pass the video information to the shift register 72 which loads that information in response to timing pulses produced by the synchronization circuit 70 at its B′ output (FIG. 17).

However, after the loading of information meant for row Y, and represented by pulses 80A′–N′ into shift register 72 has been completed, and the shift register is no longer able to receive information because the output A′ of synchronization circuit 70 has returned to 0, as illustrated in FIG. 16, output D′ of synchronization circuit 70 then goes positive causing the output of shift register 72 to drive the pixels in row Y, thereby displaying the desired information. This sequence concludes with pulse 85′ advancing the ring counter to its Z output (not shown). The above sequence is then repeated until the entire panel has been filled with video information. Then, upon the receipt of a second beginning of the frame timing pulse 82, the entire process is repeated.

Because the amount of time needed to transmit, receive and process the information digitally is very small, a relatively long period of time may be required to actuate a pixel, typically in the order of 0.01 seconds. Thus, it may be advantageous to multiplex a plurality of signals when transmitting video information. For example, referring to FIG. 14, time t could be set equal to one millisecond. In the same case, time y, that is the time during which the shift register drives the pixels in a row, could be set equal to 50 milliseconds. Using this example, it would thus be possible to stagger informational pulse bundles having a total duration of one millisecond under a time-multiplexing scheme in which information for nearly fifty panels would be sent over the same channel.

Figure 20:
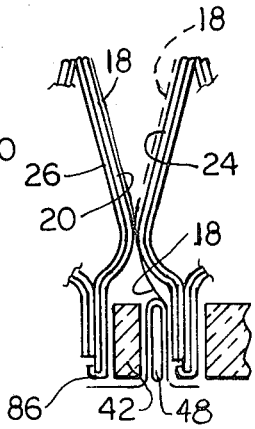
FIG. 20 is a view similar to FIG. 2 of an alternative embodiment of the instant invention.

Referring to FIG. 20, an alternative embodiment of a pixel useful in panel 10 is illustrated. The operation of this pixel is substantially identical to that of the pixel illustrated in FIG. 2, and corresponding parts have been given the same reference numerals as in FIG. 2. However, mylar sheet 28 does not include bends at points 36 and 44 in order to form the sheet into a configuration where it makes contact with shield 20. Instead shield 20 extends around the bottom of substrate 26 to form a base contacting surface 86. Accordingly, the contacting structure is somewhat simplified. Another difference between the structures is the shape of curved member 22 and, accordingly, the reflective surface of insulative layer 24. Specifically, curved member 22 includes a curved portion 16b which deflects the tongue to the desired position.

Figure 21:
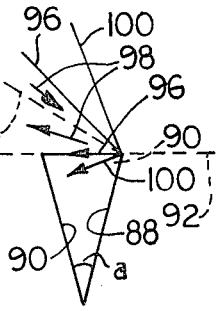
FIG. 21 is a diagram illustrating the optics of the embodiment of the invention illustrated in FIG. 20.

For many purposes, the optics provided by such a configuration may be desirable. These optics are illustrated in FIG. 21. Abstractly, the reflecting surfaces include a mirrored surface 88 and a non-mirrored surface such as red or black paint 90. The surfaces are at an angle a with respect to each other. The display plane of the display panel including the pixel is defined by dashed line 92. For purposes of analysis, we will also define a perpendicular line 94 which is perpendicular to surface 88. Perpendicular line 94 is at an angle a′ with respect to the plane of display 92 which is analogous to the plane defined by panel 10 in FIG. 1. Angle a′ is equal in magnitude to angle a. Thus, a ray of light 96 striking the mirrored surface 88 at an angle relative to the plane of display of slightly less than 2a would be reflected and would just miss surface 90. Likewise a ray of light 98 striking the surface at an angle much less than 2a will also be reflected similarly.

However, whenever a ray of light, such as ray 100, approaches the display panel 10 and surface 88 at an angle having a magnitude greater than twice that of angle a it will be reflected against surface 90 which, because it is red, will color the reflected light. Thus, the pixel will appear red for an angle of view equal to 180−4a degrees. Outside this angle of view it is possible for a viewer to directly see reflected light instead of the red or black characteristic color of the pixel. If, on the other hand, light is incident directly on surface 90, the pixel will appear the color of the non-mirrored surface 90 which faces the mirrored surface of the tongue. Thus, for the configuration shown in FIG. 21, within the angle of view, the pixel will always appear the color of the surface opposite the mirrored surface. In practice, it has been determined that angle a, that is the angle between the outer portions of the reflective surfaces of the pixel, should be limited to about 22.5 degrees as a practical display should have an angle of viewing of at least 90 degrees.

The above analysis applies to rays of light striking surface 90 or reflecting from surface 88. Rays of light leaving surface 90 and striking surface 88 will form a reflection of surface 90 which will appear to the eye of the viewer the same color as surface 90.

Thus, all light impinging upon the surface of a pixel will be reflected by the mirror surface of the tongue against the reflective surface of the shield or the electrode, where it will be seen as the color of the shield or electrode or it will be reflected at an angle less than 2a with respect to the plane of view (outside the useful angle of viewing) or it will impinge directly on the reflective surface of the fixed electrode or shield and will be colored thereby. In this respect, the verb "color" means to include total absorption of a light wave by a black surface as well as selective absorption by a surface exhibiting different reflectivities for light of different wavelengths.

INDUSTRIAL APPLICABILITY

The display panel 10 of the present invention is particularly advantageous inasmuch as it lends itself to a relatively economical and efficient assembly technique. In particular, it is contemplated that the panel would be assembled a column at a time. Thus, one would obtain a sheet of mylar 28, burn away the metalized coating on both sides along stips 34 using a chemical or laser light to define a plurality of rows 32, and cut a column of tongues 18 by cutting along lines 30 (FIG. 5). The sheet would then be bent at points 36 and 44, shims 40 and 46 inserted and clear plastic bar 42 positioned as illustrated in FIG. 2. The parts would be glued together. A conductive cement would be used to adhere the mylar sheet 28 to the base portion of shield 20 deposited on substrate 26. The mylar sheet 28 would then be formed with the tongue 18 and shim 48 positioned as illustrated in FIG. 2. Another substrate 26 with a fixed electrode 16 attached to it would then be positioned and the fixed electrode, shim 48 and clear plastic bar 42 adhered to each other.

It is noted that the above description of a method of assembly contemplates the simultaneous manufacture of a complete column of pixels in a single operation and the successive repetition of that operation to form a complete panel. The fixed electrode assembly including the fixed electrode, substrate, shields 20 deposited thereon and dielectric layer 24 would be prefabricated with a number of shields 20 equal to the number of pixels in the column.

It is thus seen how a reflective display panel may be provided. It is contemplated that the inventive display panel would be used under direct reflected light and, in the darkness, would be backlit because of the fact that windows 54 will transmit such light under viewing conditions where there is no ambient light. Alternatively, if it is contemplated that the panel would be viewed only under reflected light, improved optics may be obtained by covering the front surface of plastic bar 42 with a layer 96 of black paint. Alternatively, it may even be desired to use a paint which will transmit light when subjected to intense backlighting but absorb substantially all incoming radiation. If such a paint is used a display for use under reflected and backlighting conditions may include such a layer of paint.

While an illustrative embodiment of the present invention has been described, it is, of course, understood that various modifications will be obvious to those of ordinary skill in the art. Such modifications are within the spirit and scope of the invention which is limited and defined only by the appended claims.

I claim:

1. A multi-element reflective display device, comprising:

(a) a plurality of shielding means positioned at spaced intervals with respect to each other, each of said shielding means having a surface of first reflectivity;

(b) a plurality of conductive fixed electrodes, each of said fixed electrodes having a surface of second reflectivity, said second reflectivity being different from said first reflectivity, each of said fixed electrodes being positioned between adjacent shielding means with its surface of second reflectivity in facing relationship to a respective one of said surfaces of first reflectivity;

(c) a single sheet of conductive material defining a plurality of tongues, each of said tongues having a base portion and tip portion, said plurality of tongues being defined in a row;

(d) means for supporting said fixed electrodes and each of said shielding means in said facing relationship and for supporting each of said tongues with their tips between a surface of first reflectivity and its respective facing surface of second reflectivity and in spaced relationship to said surface of second reflectivity;

(e) first conductor means integral with said single sheet for connecting to all of said tongues; and (f) a plurality of second conductor means for electrically connecting to each of said fixed electrodes, whereby application of a voltage to said first conductor means and one of said second conductor means results in attraction of the tongue adjacent the electrode associated with said one of said second conductor means to said associated electrode.

2. A multi-element reflective display device as in claim 1, wherein said single sheet of conductive material is positioned, configured and dimensioned in such a manner that light passing from a source behind said sheet will pass through holes defined by said sheet to said tongues and be blocked by said tongues, whereby actuation of an individual tongue by application of a voltage potential between said individual tongue and its respective fixed electrode will result in displacement of said tongue against said fixed electrode and the passage of light between said tongue and the surface of first reflectivity facing said surface of second reflectivity on said fixed electrode.

3. A multi-element reflective display device as in claim 1 or 2, wherein said support means comprises a plurality of blocks of transparent material each secured to a respective shielding means and fixed electrode.

4. A multi-element reflective display device as in claim 1, wherein said sheet is made of a polymeric material with a layer of conductor deposited on both of its sides.

5. A multi-element reflective display device as in claim 1, wherein said tongue has an area equal to or less than the area of a hole defined by said sheet adjacent to the base of said tongue.

6. A multi-element reflective display device as in claim 5, wherein said shielding means is electrically conductive and further comprising a plurality of first shim means around which and adjacent to which said sheet bends, bringing said sheet into electrical contact with said shielding means, whereby said sheet may be bent without substantially affecting the conductive properties of said sheet.

7. A multi-element reflective display device as in claim 6, further comprising second shim means for supporting elements of the display device and maintaining its structural strength.

8. A multi-element reflective display matrix, comprising a plurality of adjacent rows of display devices, each of said rows of display devices comprising the elements recited in claim 1, 2, or 6 and wherein the sheets of conductive material of each of said rows of display elements are all deposited on a single sheet of non-conductive material, said conductive sheets being a thin layer of metal and said non-conductive material being a polymeric material.

9. A multi-element reflective display device as in claim 1, 2 or 6 wherein said sheet has a mirrored surface, whereby each of said tongues also has a mirrored surface, said fixed electrodes and said shielding means being configured and dimensioned and positioned with respect to each other in such a manner that when the side of a tongue opposite its mirrored surface is in abutting relationship to one of its respective shielding means or fixed electrode, said one of its respective shielding means or fixed electrode supports said tongue forming its mirrored surface into a shape where light incident upon said display is incident upon the other of said shielding means or fixed electrode means, or is incident upon said mirrored surface and reflected against said other of its shielding means or fixed electrode or reflected from said mirrored surface at an angle with respect to a plane of display defined by said display that is less than (180-A)/2 degrees where A is the useful angle of view of the display device.

10. A multi-element reflective display device as in claim 1, 2 or 6 wherein said sheet has two mirrored surfaces, said fixed electrodes and said shielding means being configured and dimensioned and positioned with respect to each other in such a manner that when the side of a tongue opposite one of its mirrored surfaces is in abutting relationship to one of its respective shielding means or fixed electrode, said one of its respective shielding means or fixed electrode supports said tongue forming said one of its mirrored surfaces into a shape where light incident upon said display is incident upon the other of said shielding means or fixed electrode means, or is incident upon said mirrored surface and reflected against said other of its shielding means or fixed electrode or reflected from said mirrored surface at an angle with respect to a plane of display that is outside the useful angle of view of the display devise, said useful angle of view being greater than 72 degrees.

11. A variable reflectivity display element, said display element defining a plane of display, comprising, a first reflective member at least a portion of said first reflective member defining a first reflective surface having a first reflectivity; a second reflective member at least a portion of said second reflective member defining a second reflective surface having a second reflectivity, said second reflectivity being different from said first reflectivity; a flexible leaf having a mirrored surface, said leaf being maintained in a position where one side of said leaf is adjacent one of said reflective members; means for attracting said leaf to the other of said reflective members; said first and second reflective members being configured and dimensioned, and supported in a position in facing relationship with respect to each other in such a manner that when the side of said leaf opposite said mirrored surface is in abutting relationship to one of said reflective surfaces, said one of said reflective surfaces supports said leaf forming said mirrored surface into a shape where light incident upon said element is incident upon the other of said reflective surfaces, or is incident upon said mirrored surface and reflected against said other of said reflective surfaces or incident on said mirrored surface and reflected from said mirrored surface at an angle with respect to said plane of display that is less than (180−A)/2 degrees, where A is the useful angle of view of the display device.

12. A variable reflectivity video display comprising a plurality of display elements as in claim 11, wherein said first and second reflective members are positioned, configured and dimensioned each to define a plurality of parallel planes parallel to the planes of said first and second reflective members, all the planes defined parallel to the first reflective member being at an angle of 22.5° or less with respect to all of the planes defined parallel to the second reflective member.

13. A variable reflectivity display element as in claim 11, wherein said leaf includes means for concentrating charges on said leaf and said leaf is electrically attracted to the other of said reflective members.

14. A method of making a two-dimensional display device, comprising the steps of:

(a) dividing the conductive coating on a non-conductive material covered with a conductive coating into a plurality of rows;
(b) cutting a plurality of tongues in a column into each of said rows;
(c) forming said non-conductive sheet into a configuration where said tongues are in spaced relationship;
(d) introducing a fixed electrode adjacent said plurality of tongues with said electrode extending transverse to said rows;
(e) providing suitable conductor means for connecting to said fixed electrode; and
(f) providing a plurality of second suitable conductor means for connecting to said tongues.

15. A two-dimensional display device comprising a matrix of variable reflectivity display elements, said matrix defining a plane of display, each of said elements, comprising, a first reflective member at least a portion of said first reflective member defining a first reflective surface having a first reflectivity; a second reflective member, at least a portion of said second reflective member defining a second reflective surface having a second reflectivity, said second reflectivity being different from said first reflectivity; a flexible leaf having mirrored surfaces on both its sides, said leaf being maintained in a position where one side of said leaf is adjacent one of said reflective members; means for attracting said leaf to the other of said reflective members; said first and second reflective members being configured and dimensioned, and supported in a position in facing spaced relationship with respect to each other in such a manner that when the side of said leaf opposite one of said mirrored surfaces is in abutting relationship to one of said reflective surfaces, the visible portions of said mirrored surface and said other reflective surface substantially define a pair of planes which are at an angle with respect to each other that is much less than the useful angle of view of the display element.

* * * * *